United States Patent [19]

Green

[11] Patent Number: 5,074,087

[45] Date of Patent: Dec. 24, 1991

[54] DOORS OF COMPOSITE CONSTRUCTION

[75] Inventor: F. Richard Green, Hamilton, Ohio

[73] Assignee: Pease Industries, Inc., Fairfield, Ohio

[21] Appl. No.: 595,269

[22] Filed: Oct. 10, 1990

[51] Int. Cl.[5] ..... E04C 2/10

[52] U.S. Cl. ..... 52/309.9; 52/455; 52/807

[58] Field of Search ..... 52/455, 456, 457, 458, 52/309.9, 807

[56] References Cited

U.S. PATENT DOCUMENTS

| | | |
|---|---|---|
| Re. 24,558 | 10/1956 | Tyree . |
| 1,100,555 | 6/1914 | Goddard . |
| 1,911,374 | 5/1933 | Loetscher . |
| 2,717,062 | 9/1955 | Dusing et al. . |
| 3,287,854 | 11/1966 | Dasovic et al. . |
| 3,423,878 | 1/1969 | Kimmel . |
| 3,924,377 | 12/1975 | Gill . |
| 3,987,600 | 10/1976 | Baehr . |
| 3,994,110 | 11/1976 | Ropella . |
| 4,068,431 | 1/1978 | Pitt . |
| 4,281,493 | 8/1981 | Pitt . |
| 4,327,535 | 5/1982 | Governale . |
| 4,374,693 | 2/1983 | Pitt . |
| 4,429,498 | 2/1984 | Pitt . |
| 4,643,787 | 2/1987 | Goodman . |
| 4,864,789 | 9/1989 | Thorn . |
| 4,920,718 | 5/1990 | Atwick et al. . |

FOREIGN PATENT DOCUMENTS

| | | |
|---|---|---|
| 493777 | 6/1953 | Canada . |
| 2807890 | 9/1979 | Fed. Rep. of Germany . |
| 0150335 | 8/1985 | Fed. Rep. of Germany . |
| 722017 | 3/1932 | France . |
| 807749 | 1/1937 | France . |
| 685777 | 12/1965 | Italy . |
| 0077439 | 6/1977 | Japan . |
| 2051177 | 1/1981 | United Kingdom . |

*Primary Examiner*—David A. Scherbel
*Assistant Examiner*—Kien Nguyen
*Attorney, Agent, or Firm*—Wood, Herron & Evans

[57] ABSTRACT

A panel door of composite construction includes a pair of stiles and top and bottom rails which cooperate to define a rectangular frame, a plastic foam core bordered by the frame and an opposed pair of molded fiberglass skins which sandwich the frame and core. Each skin has an edge located rim portion which overhangs the outer corner edges of the stiles and rails, and each of the stiles and rails has an outer corner edge with a profile complementary to and mating with the inside of the adjacent rim portion. Along the side edges, the skins have innermost and outermost rim portions, and the stiles have complementary profiled outer corner edges.

10 Claims, 5 Drawing Sheets

DOORS OF COMPOSITE CONSTRUCTION

BACKGROUND OF THE INVENTION

The assignee of this invention has during the past quarter-century manufactured and sold great quantities of doors in accordance with its Pease Pat. No. 3,153,817. These doors comprise a pair of stiles and top and bottom rails of wood cooperating to define a rectangular frame, a pair of opposed skins of sheet steel mounted on this frame and cooperating therewith to define an enclosed interior space, and a plastic foam core substantially filling that interior space. The metal skins have been finished by painting, and they have also been provided both with integrally formed panel portions and with inset window panels.

These metal skin doors have been consistently successful and popular, but there is also a market for doors of composite construction which include skins of materials capable of receiving decorative finishes not generally applicable to steel skins. For example, it has been proposed to form the skins of a compression molded resin reinforced with glass fibers which can be molded to the desired dimensions and at the same provided with an outer surface design reproducing a wood grain pattern. The present invention is directed to the production of improved doors of composite construction as further described hereinafter.

SUMMARY OF THE INVENTION

A preferred embodiment of the invention is a door of composite construction comprising a pair of stiles and top and bottom rails cooperating to define a rectangular frame, with each side of this frame being covered by a skin of molded reinforced resin, and with the space enclosed by the frame and skins filled with a plastic foam core.

The skins which form the faces of the door are of special configuration which establishes a firm interfitting relation between the outer edges of each skin and the wooden frame around the entire periphery of the door. More specifically, while by far the major portion of each skin is of a uniform minimum thickness, each skin includes along each edge on the inside thereof a rim portion of greater thickness which forms a flange proportioned to overhang the outer corner edge of the adjacent stile or rail, and this edge of each stile and rail is provided with a profile complementary to and mating with the associated flange on the skin. Thus in the finished door, the flanges on the opposed skins overhang the frame to complete the composite construction.

These and other features and advantages of the doors of the invention will be apparent from or are pointed out in connection with the description of the preferred embodiment which follows.

DESCRIPTION OF THE PREFERRED EMBODIMENT

Figure 1:
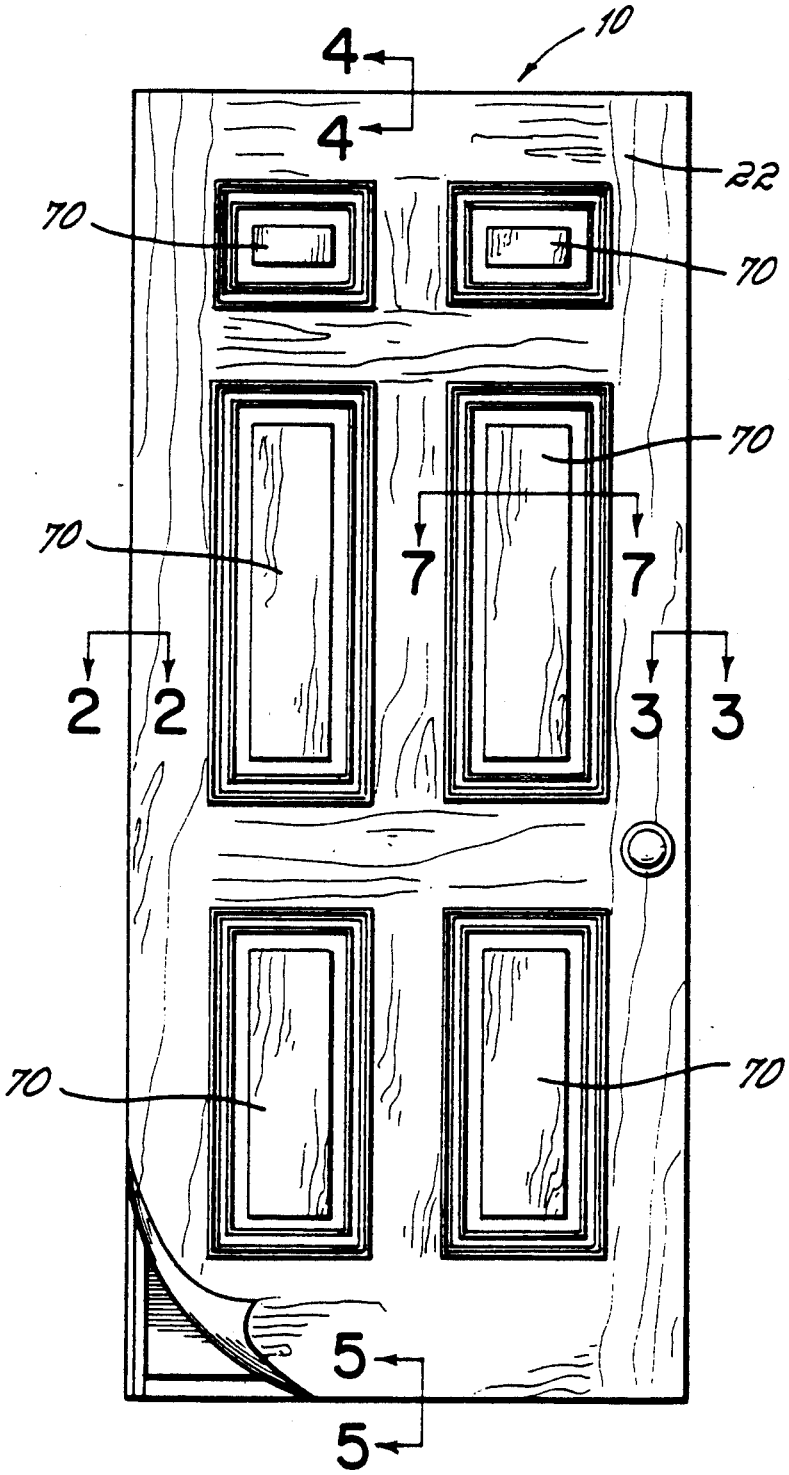
FIG. 1 is a view in elevation of the face of a door constructed in accordance with the preferred embodiment of the invention.

The door 10 in FIG. 1 includes a rectangular wooden frame formed by a hinge side stile 11 on which the hinges 12 are mounted, a lock side stile 13 of the same cross section, a top rail 14 and a bottom rail 15 of the same cross section as the top rail 14. In the preferred embodiment, the stiles 11 and 13 run the full length of the frame and overlie the ends of the two rails. The practice of the invention is such that the abutting portions of these wooden frame members need not be fastened together, but attachment therebetween can be made by adhesive and/or staples, nails or screws. The space enclosed by these wooden frame parts is substantially filled with a plastic foam core 20, which may be preformed or may be foamed in place.

The entire frame is covered on each side by a skin 22 of compression molded resin incorporating reinforcing fibers. The resin may be of any conventionally used sheet molding compound, e.g., a polyester resin, it may include a pigment, and the reinforcement may be fibrous glass. Preferably, the molds by which the skins 22 are formed will impart to the outer surface thereof a pattern simulating a desired wood grain.

Each of the skins 22 is of a substantially uniform minimum thickness, e.g., 0.100 inch, over the major portion of its area, but each skin also includes on the inside and along each edge thereof a rim portion of greater thickness which is continuous around the entire periphery of the skin, and which overhangs a complementarily profiled corner edge portion of the adjacent rail or stile, as now described. Thus referring to FIGS. 2 and 3, each of the skins 22 has along the inside of its side edges a rim portion 25 of substantially greater thickness than the adjacent major portion of its area, e.g., twice as thick or 0.200 inch.

Each of these rim portions 25 is configured near its inner edge to form a shoulder 26 which is perpendicular to the outer surface of the skin 22 and fits over a complementarily formed shoulder portion of the adjacent stile 11 or 13. Along its outer edge, each rim portion 25 includes a flange 30 which extends further than the shoulder 26 by, for example, an additional 0.100 inch. The adjacent corner edge of each of stiles 11 and 13 is profiled at 31 to fit inside this flange 30 while a portion of the outer surface of each stile is exposed between and flush with the outer end surfaces of the flanges 30 so that it can receive the usual latch assembly in the stile 13 or the mounting screws for each hinge 12 in the stile 11.

In the preferred practice of the invention, the skins 22 are molded with a standard vertical dimension, e.g., 80 inches (nominal, actually 79 ⅛), and a maximum width equal to that of conventional doors, namely 36 inches. However, since doors of the type to which the invention relates are commonly made in widths which vary in two-inch increments from a maximum of 36 inches to a minimum of 26 inches, provision is made for trimming the width of each skin 22 so that it can be used in the construction of a door of a standard width less than 36 inches, namely 26, 28, 30, 32, 34 or 36 inches.

Figure 2:
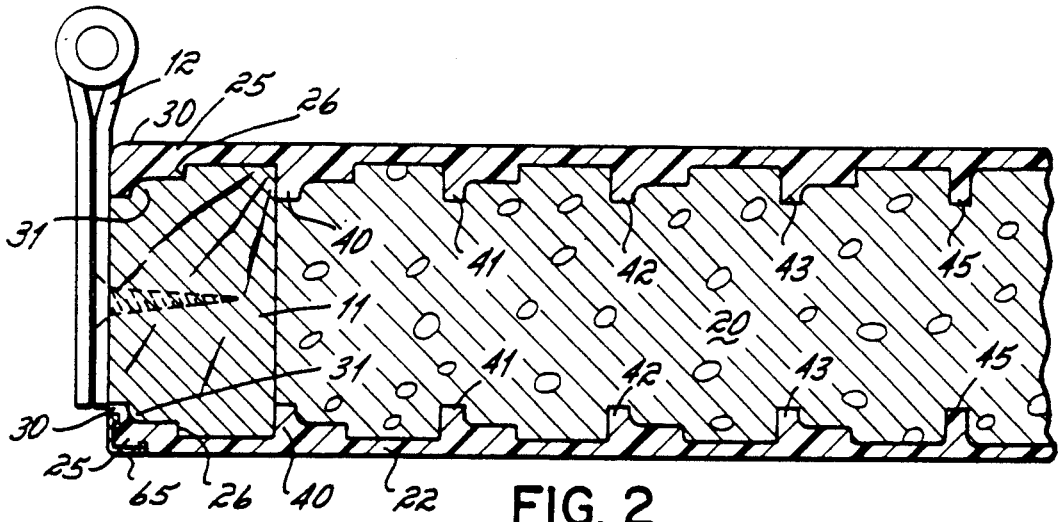
FIGS. 2 and 3 are enlarged fragmentary sections on the lines 2—2 and 3—3 respectively in FIG. 1 showing details of the door adjacent the hinge side and lock side thereof, respectively.
Figure 3:
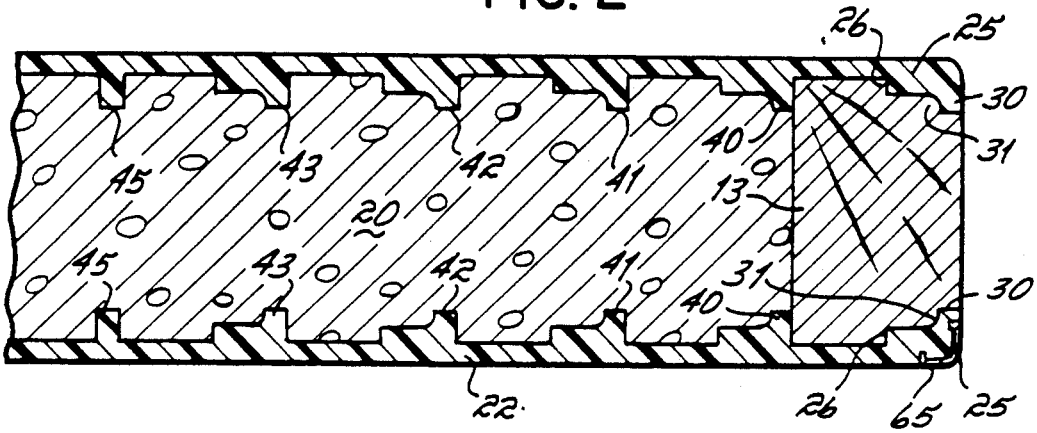

More specifically, the thickened portion 25 along the side edge of each skin 22 is repeated at one-inch intervals from the edge to provide flanges 40, 41, 42 and 43 along the inner surface adjacent each side edge of the skin. When a pair of these skins is to be incorporated in a door of the maximum width, then the opposed flanges 40 serve as retaining stops for receiving and supporting the inner surface of each of the stiles 11 and 13, as shown in FIGS. 2 and 3. If the finished door is to be of a lesser width, e.g., 32 inches (nominal), each skin would be trimmed to leave the flanges 41 along its outer side edges, and in this case the flanges 42 would support the inner surface of the stiles 11 and 13.

For doors of the minimum width, for which the skins would be trimmed to leave the flanges 43 along their side edges, the inner surfaces of the stiles 11 and 13 are supported by flanges 45 appropriately spaced inwardly of the flanges 43. Each flange 45 could run the full height of each skin, like the flanges 40–43, but preferably the flanges 45 are composed of vertically spaced and aligned relatively short sections, which may be as short as 1 inch so long as there are enough thereof, e.g., eleven, to support and keep straight the associated stile.

Figure 5:
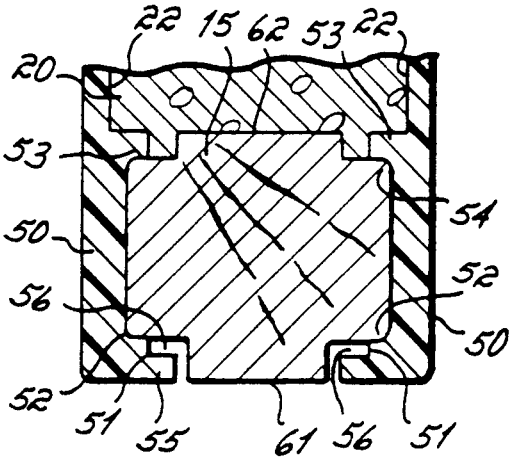
FIG. 5 is a similar section through the bottom of the door on the line 5—5 in FIG. 1.

The configuration of each skin 22 along its top and bottom edges is different from along its sides as just described. Referring to FIG. 5, each skin has along the inside of its bottom edge a rim portion 50 of substantially greater thickness than the adjacent major portion of its area, e.g., twice as thick or 0.200 inch. Each of these thickened portions 50 includes near its bottom edge a portion of still greater thickness, e.g., an additional 0.100 inch, which forms a shoulder 51, and the adjacent corner edge 52 of the bottom rail 15 is profiled to fit and seat on this shoulder.

Along its upper edge, each rim portion 50 at the bottom of the door includes a shoulder portion 53 similar to the shoulder 51 which fits over and holds the complementarily profiled corner edge 54 of rail 15. The shoulder portion 53 may run the full width of the skin, but preferably it is discontinuous and may comprise, for example, three laterally spaced sections which may each be as short as one inch in length, and which are spaced across the inner surface of the skin between the flanges 45.

Each skin 22 also includes, below the shoulder 51, a flange 55 which interconnects at the corners of the skin with the side flanges 30, and which projects horizontally beyond the shoulder 51 to define a slot 56 between itself and the adjacent bottom surface of the rail 15. The two slots 56 cooperate to provide tracks for receiving and holding a bottom cap, not shown, for weatherproofing purposes. The rail 15 includes a longitudinal rib portion 61 on its underside which substantially fills the space between the two male supporting portions of the weatherstripping 60.

Figure 4:
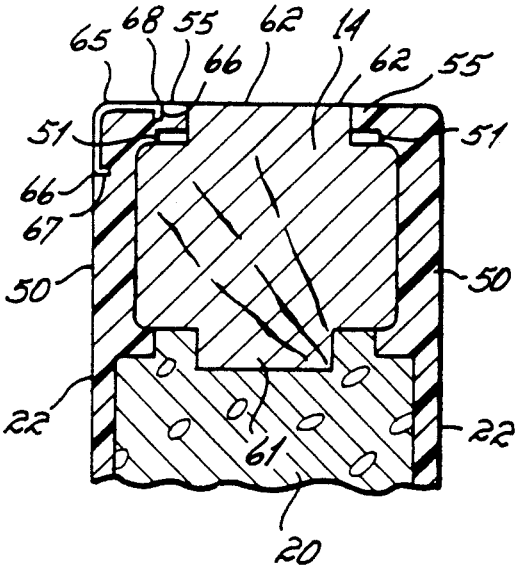
FIG. 4 is an enlarged fragmentary section through the top of the door on the line 4—4 in FIG. 1.

Each skin 22 has the same configuration along its upper edge as along its bottom edge, and the portions thereof are provided with the same reference characters in FIG. 4 because with this configuration, either end of the skin may be the top end in the finished door. The determination of which is the top end is made while the parts are being assembled, because the top rail 14 is of the same cross section and has the same orientation in the door as the bottom rail 15. Note, however, that while the rib portion 62 along the top of bottom rail 15 does not contact any part of skins 22, this rib portion 62 along the top of each of these rails is proportioned to fit between the flanges 55 along the top of the door to provide the door with a smooth and substantially continuous upper surface.

One advantageous result of this aspect of the invention is that all rails 14 and 15 are of the same cross sectional dimensions, whether used at the top or bottom of the door, and similarly all stiles 11 and 13 are of the same cross sectional dimensions. Typically, with the skins 22 dimensioned as described above, each of the stiles and rails may have a width of 1.5 inches to provide the finished door with a nominal thickness of 1.75 inches.

In assembling a door embodying the invention, one of the skins 22 is supported in horizontal position with its inner surface uppermost, and after that surface has been coated with adhesive, such as a water base thermoplastic neoprene RRG contact cement, the stiles and rails are set therein in the proper positions as shown in FIGS. 2–5. The preformed core 20 is then set in place, and after the inner surface of the other skin has also been coated with adhesive, it is set with its inner surface lowermost over the remainder of the assembly, and the entire assembly is put under pressure until the adhesive has set. In the preferred practice, the core 20 is premolded with grooves in its outer surfaces complementary to the flanges and other projections on the inner surfaces of the skins, although this is not essential in that those flanges could be forced into the foam material of the core as a part of the assembly operation.

Figure 6:
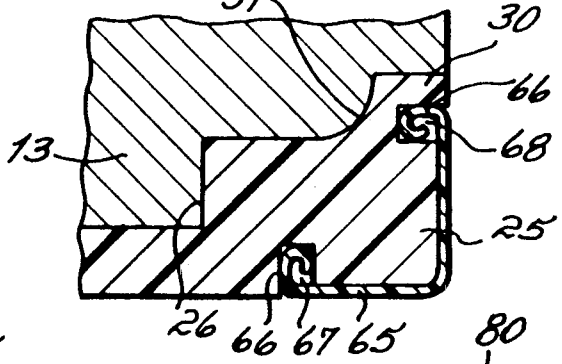
FIG. 6 is an enlarged fragment of FIG. 3.

Whenever a door constructed in accordance with the invention is to be installed in a doorway equipped with magnetic weatherstripping, that door should be provided with a narrow, right-angled trim strip 65 of magnetic metal along the corners of its sides and top which will mate with the magnetic weatherstripping in the installed position of the door, in accordance with the co-owned pending application of Norbert J. Guetle, Jr., Ser. No. 268,096, filed Nov. 7, 1988, the disclosure of which is incorporated herein by reference. Referring to FIG. 6, each of the trim strips 65 includes a flange 66 extending inwardly of its L-shape along each of its outer edges and having a curled edge portion, and these flanges are forced into a pair of grooves 67 and 68 in the outer face and outer edge of the skin.

Also, the outer surface of the corner portions of the skin which are covered by the trim strips 65 are relieved by an amount equal to the thickness of the trim strip, so that the outer surface of the trim strip will be flush with the adjacent surfaces of the skin. The grooves 67–68 and the relieved areas therebetween could be molded into the skin, but this would require separate molds for the two skins on each door. Accordingly, these grooves and the relieved areas are preferably machined after the door has been assembled.

Figure 7:
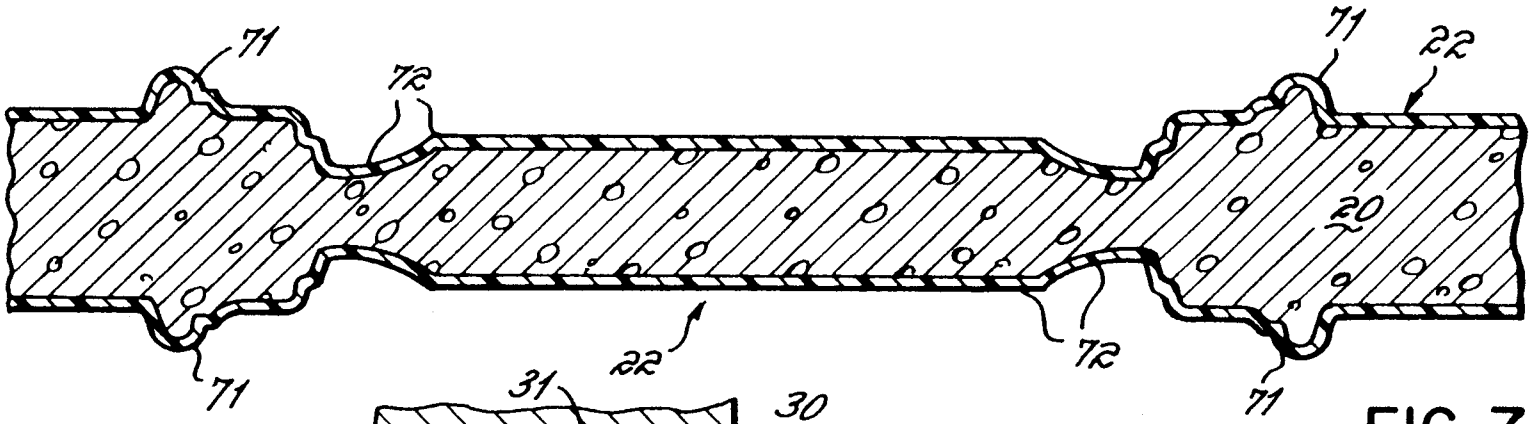
FIG. 7 is an enlarged fragmentary section on the line 7—7 in FIG. 1.

The main area of each skin 22 which lies inside the wooden frame may be configured to present a wide variety of designs, which are formed in the skin during the compression molding thereof. Thus FIG. 1 shows the door as provided with a pattern composed of six rectangular panel portions 70, and as illustrated in FIG. 7, these panel portions are defined by portions of the skin which are molded so that some portions 71 extend outwardly and other portions 72 extend inwardly of the main plane of this skin defined by the portions of the skin which are parallel with the wooden frame. Preferably the surfaces of the core 20 will be similarly molded to receive and conform with the panel-designing areas of the skin.

Figure 8:
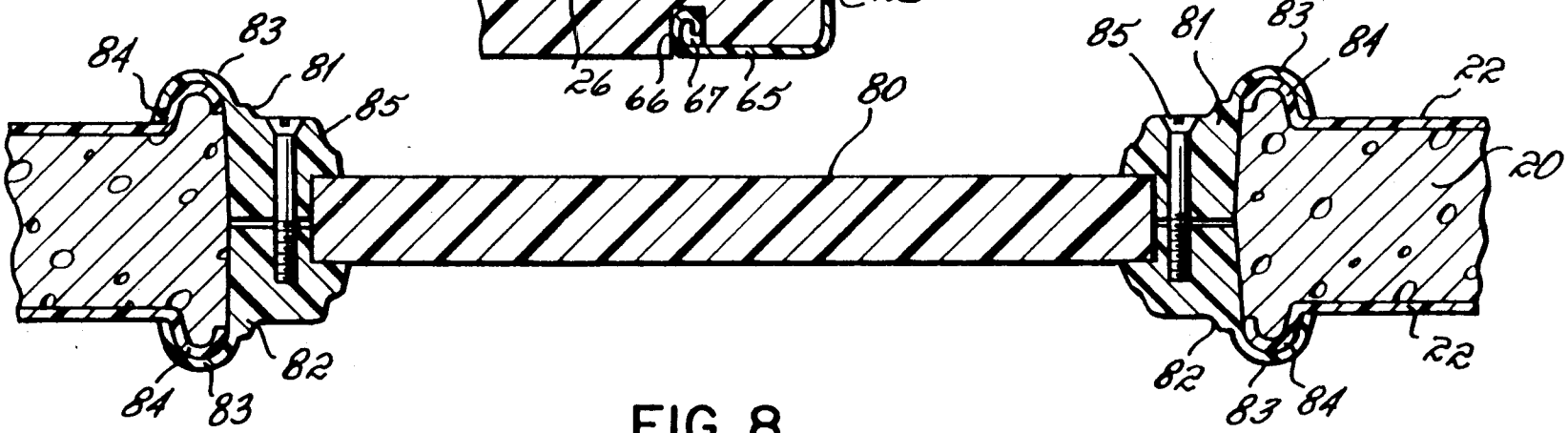
FIG. 8 is a view similar to FIG. 7 showing a modified form of the door in FIG. 1.

It is also possible and practical to provide the doors of the invention with light transmitting panels, as shown in FIG. 8 and as more fully disclosed in the co-owned application Ser. No. 07/543,205, entitled "Molded Panel Door With Integral Raised Trim," filed on June 22, 1990, and the disclosure of which is incorporated herein by reference. In FIG. 8, a glass panel 80 is mounted to fill a hole cut through one of the doors of the invention. Each side of the glass panel 80 is supported in a pair of complementary mouldings 81–82 of plastic, and these mouldings include flange portions 83 which extend along their outer corners and are configured to fit in clamping relation over complementary portions 84 of the skins 22 which surround the hole in which the glass panel is mounted. Screws 85 secure the pairs of mouldings together in clamping relation with both the glass panel 80 and the portions 84 of the skins.

Figure 9:
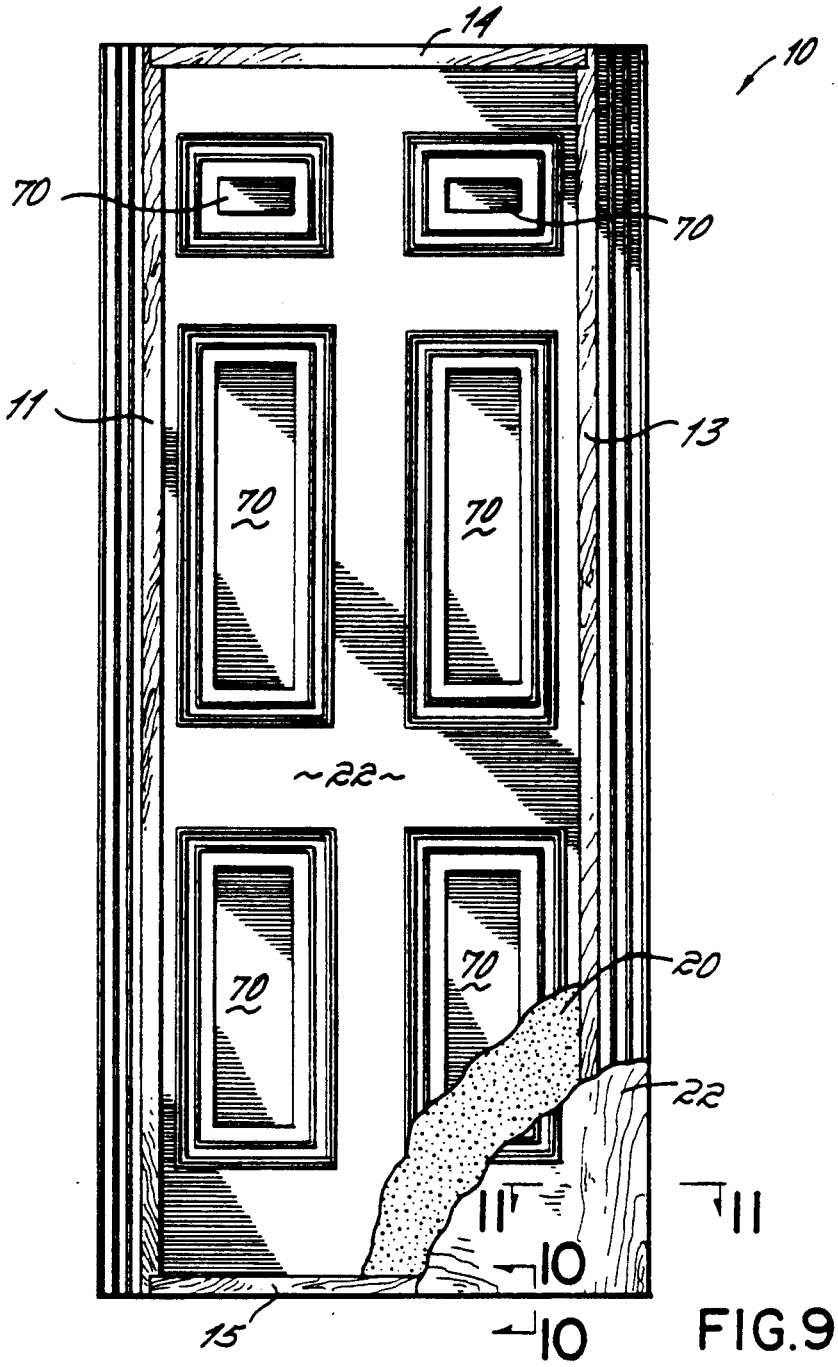
FIG. 9 is a view in elevation, similar to FIG. 1, of the face of a door constructed in accordance with an alternate embodiment of the invention.
Figure 10:
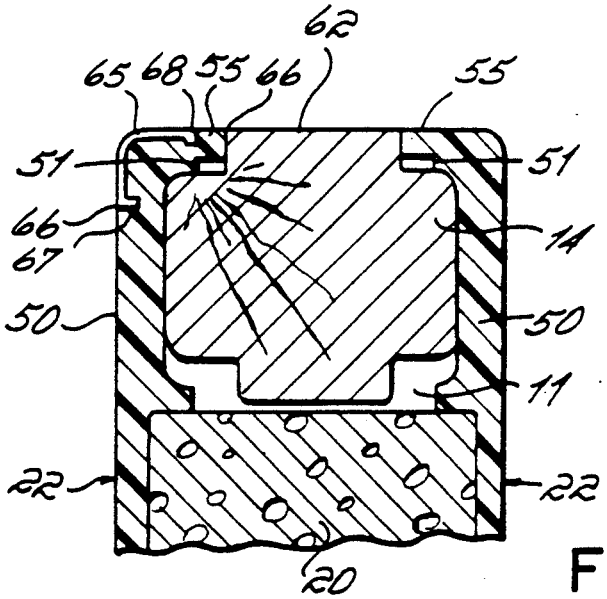
FIG. 10 is a cross-sectional view taken along line 10—10 of FIG. 9.

FIGS. 9 and 10 show a door 10 in accordance with an alternate embodiment of the invention. In this embodiment, as shown in FIG. 9, the top rail 14 and the bottom rail 15 are located in proper position by dimensional cutouts in the upper and lower inner ends of the stiles 11 and 13. Thus, by accurately positioning the stiles 11 and 13, and then locating the rails 14 and 15 within the inwardly directed cutouts, the wooden frame is accurately centered upon the skin during construction. As shown in FIG. 10, it is not necessary to rely upon a shoulder extending upwardly from the inside surface of the skin for the purpose of locating the rails 14 and 15. In fact, the rails 14 and 15 are preferably dimensioned such that, if the skins include such shoulders, these shoulders do not contact the rails 14 and 15.

Figure 11:
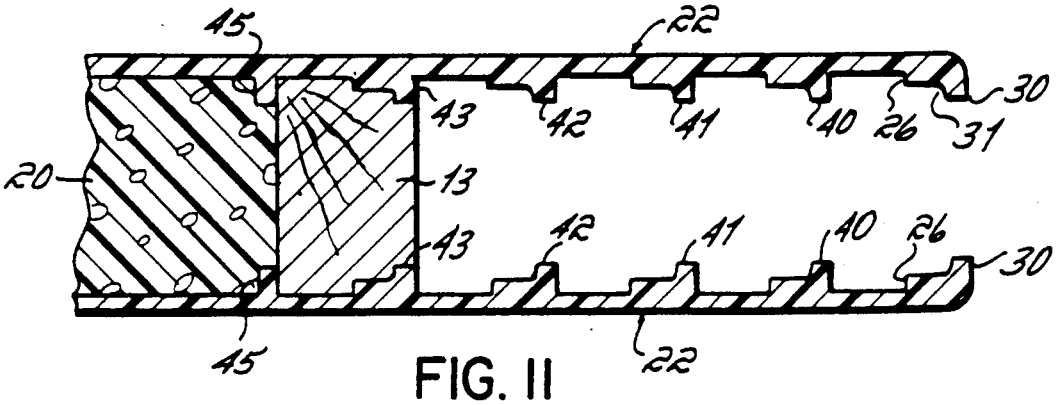
FIG. 11 is a cross-sectional view taken along lines 11—11 of FIG. 9, showing a feature of the invention related to both embodiments.

FIG. 11 shows, in partial view, an intermediate step involved in constructing a door 10 with a lesser width than the door shown in FIGS. 1–9. After the skins 22 are compressed upon the frame, the "extra" skin material is cut away to form a door 10 of reduced width. Alternately, the skins 22 could be cut prior to assembly and compression. Regardless of the width of the door 10, the flanges 40, 41, 42, 43, 44 and 45 on the internal surfaces of the skins 22 provide precise, interior and exterior positioning of the stiles 11 and 13 along their entire length.

While the articles herein described constitute preferred embodiments of the invention, it is to be understood that the invention is not limited to these precise articles, and that changes may be made therein without departing from the scope of the invention which is defined in the appended claims.

What is claimed is:

1. A door of composite construction comprising a pair of stiles and top and bottom rails cooperating to define a rectangular frame, and a pair of opposed skins of molded reinforced resin mounted on said frame and cooperating therewith to define an enclosed interior space, and further characterized in that (a) each of said skins is of substantially uniform minimum thickness over the major portion of the area thereof, (b) each of said skins includes along each edge of the inside thereof a rim portion of greater thickness than said minimum thickness, (c) said rim portions of said skins include edge portions proportioned to overhang said outer corner edges of said stiles and rails and thereby to retain said stiles and rails in partially enclosed relation and also to define the corner edges of the sides and the top and bottom of said door, (d) each of said stiles and rails has along the outer corner edges thereof a profile complementary to and mating with the inside of the adjacent said rim portion of said skin; and (e) each said rim portion along the side edges of said skins includes both an inner portion of sufficiently greater thickness than said minimum thickness to form a shoulder and also an outermost portion of still greater thickness to form a flange extending further inwardly of said enclosed space than said shoulder, and each of said stiles has the outer corner edges thereof profiled to match and engage said shoulders and flanges.

2. A door as defined in claim 1 further characterized in that adjacent each edge thereof, each of said skins includes flange means on the inner surface thereof which is parallel with the adjacent said rim portion and is so spaced inwardly from said rim portion that is engages and retains the corner edge of the adjacent said stile or rail.

3. A door as defined in claim 1 further characterized in that each said rim portion along the bottom edge of each of said skins includes both an inner portion of sufficiently greater thickness than said minimum thickness to form an inner shoulder and also an outermost portion of still greater thickness to form an outer flange extending further inwardly of said space than said inner shoulder and spaced below said inner shoulder, and said bottom rail has the bottom thereof configured to provide a slot between said rail bottom and each of said flange for receiving and retaining a bottom cap along the bottom of said door.

4. A door as defined in claim 3 characterized in that each said rim portion along the top edge of each of said skins duplicates the configuration of said rim portion along the bottom edge of said skin as defined in claim 6, said top and bottom rails are of identical cross section and are similarly oriented in said door, and each of said rails includes a rib portion along the top thereof which is proportioned to fill the space between said outer flanges on the tops of said skins.

5. A door as defined in claim 4 wherein each of said top and bottom rails includes a rib portion extending along the underside thereof which is proportioned to depend between and in spaced relation with said flanges along the bottom edges of said skins.

6. A door as defined in claim 1 further characterized by a strip of magnetic metal of generally L-shape in section extending in secured enclosing relation with said corner edges of one of said skins along the top and at least one side of said core for magnetic sealing engagement with magnetic weather-stripping in a door frame having magnetic weather-stripping along the top and lock side thereof.

7. A door as defined in claim 6 further characterized in that the areas of said corner edges of said one skin enclosed by said strips are relieved to a sufficient extent to cause the outer surfaces of said strips to be substantially coplanar with the adjacent surfaces of said skin and of the adjacent said stile and rail.

8. A door as defined in claim 6 further characterized in that each of said strips of metal has a flange along the outer edge of each of the two sides of said L-shape thereof extending inwardly of said L-shape, said one skin has grooves in the outer face and end face thereof positioned to receive said flanges on one side of said strip, and said grooves cooperate with said flanges to retain said trim strips on said door.

9. A door as defined in claim 8 further characterized in that the areas of said corner edges of said one skin enclosed by said strips are relieved to a sufficient extent to cause the outer surfaces of said strips to be substantially coplanar with the adjacent surfaces of said skin and of the adjacent said stile and rail.

10. A door of composite construction comprising a pair of stiles and top and bottom rails cooperating to define a rectangular frame, and a pair of opposed skins of molded reinforced resin mounted on said frame and cooperating therewith to define an enclosed interior space, and further characterized in that (a) each of said skins is of substantially uniform minimum thickness over the major portion of the area thereof, (b) each of said skins includes along each edge of the inside thereof a rim portion of greater thickness that said minimum thickness, (c) said rim portions of said skins include edge portions proportioned to overhang said outer corner edges of said stiles and rails and thereby to retain said stiles and rails in partially enclosed relation and also to define the corner edges of the sides and the top and bottom of said door, (d) each of said stiles and rails has along the outer corner edges thereof a profile complementary to and mating with the inside of the adjacent said rim portion of said skin; and (e) each of said skins includes adjacent each edge thereof flange means on the inner surface thereof which is parallel with the adjacent said rim portion and is so spaced inwardly from said rim portion that it engages and retains the corner edge of the adjacent said stile or rail.

* * * * *

UNITED STATES PATENT AND TRADEMARK OFFICE

CERTIFICATE OF CORRECTION

PATENT NO. : 5,074,087

DATED : December 24, 1991

INVENTOR(S) : F. Richard Green

It is certified that error appears in the above-identified patent and that said Letters Patent is hereby corrected as shown below:

Column 2, line 68, after 79 1/8, insert --"--.

Column 6, line 28, "that is" should be --that it--.

Column 6, line 41, "flange" should be --flanges.--.

Column 6, line 43, "claim 3 characterized" should be --claim 3 further characterized--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*